United States Patent [19]

Laguna de Rins

[11] 4,056,058

[45] Nov. 1, 1977

[54] SAFETY FUSE FOR UNDERWATER ARTEFACTS

[76] Inventor: Fernando Almarza Laguna de Rins, Parlo Marina Moreno 8, Zaragoza, Spain

[21] Appl. No.: 679,050

[22] Filed: Apr. 21, 1976

[30] Foreign Application Priority Data

Apr. 24, 1975 Spain ..... 436905

[51] Int. Cl.[2] ..... F42B 22/36

[52] U.S. Cl. ..... 102/16

[58] Field of Search ..... 102/16

[56] References Cited

U.S. PATENT DOCUMENTS

| | | | |
|---|---|---|---|
| 2,850,974 | 9/1958 | De Abreu | 102/16 |
| 3,179,048 | 4/1965 | De Abreu | 102/16 |
| 3,195,460 | 7/1965 | Kalaf | 102/16 |
| 3,285,170 | 11/1966 | Fietelaars | 102/16 |
| 3,884,150 | 5/1975 | Brennan | 102/16 |

FOREIGN PATENT DOCUMENTS

| | | | |
|---|---|---|---|
| 887,256 | 1/1962 | United Kingdom | 102/16 |

*Primary Examiner*—Charles T. Jordan

*Attorney, Agent, or Firm*—Ostrolenk, Faber, Gerb & Soffen

[57] ABSTRACT

A safety fuse for an underwater explosive, including a piston shiftable longitudinally to detonate the explosive, a diaphragm attached to the piston such that pressure on one side of the diaphragm moves the piston to detonate the explosive and ports communicating with one side of the diaphragm and the exterior of the fuse device for transmitting water pressure to that side of the diaphragm, thereby shifting the piston to detonate the explosive; safety devices which must be removed in order to enable water under pressure to contact the one side of the diaphragm; appropriate spring operated means for driving the piston to detonate the explosive; other protective means against inadvertent detonation.

14 Claims, 4 Drawing Figures

SAFETY FUSE FOR UNDERWATER ARTEFACTS

The object of the present invention is to improve and simplify the construction of fuses, imparting to them considerable accuracy in operation and a guarantee of permanent safety, so improving the fuses currently employed on all kinds of underwater artefacts.

One particularly important characteristic resides in the fact that the artefacts equipped with these safety fuses which are the object of the present invention do not explode on impact with the liquid mass, whether they are launched by special means, manually or from the air by means of aircraft or helicopters, since they are activated only by the progressive thrust of hydrostatic pressure and accurately.

Nor does the speed of immersion retard or advance the moment of explosion which occurs only when the artefact reaches the intended depth, upon the hydrostatic pressure acting in conjunction with an opposing spring which regulates the dept the of explosion, as will be explained hereinafter.

Safety against accidents has been enhanced considerably because although present fuses can remain permanently and screwthreadedly connected to their respective charges or mines without carrying a connected detonator, in view of the speed with which this latter may be connected for immediate use, the evident risk which is always run by anyone who has to handle the detonators has been borne well in mind, along with the no less substantial danger of storage, because it is well-known that if any one of those contained in their corresponding container should explode either accidently or fortuitously, there would instantly be a massive detonation of all, by virtue of the sensitivity and detonating power of the explosion which each contains. In order to obviate these disadvantages, it has been envisaged that the detonator by permanently incorporated into the fuse since, by virtue of the arrangement adopted, if the detonator should happen to explode — whatever the cause may be: chance, accident or even intent, as happens in acts of sabotage — the explosion would remain contained, without being boosted by the general charge, which would remain inert, without exploding, as will be explained in greater detail hereinafter.

The mines or charges equipped with the safety fuses which are the object of the present application may contain variable quantities of explosive, as suits the effects which are to be obtained. Thus, they may differ considerably in outer form, total volume and coefficient of form, it being sufficient to retain between the fuse and the respective mine or charge the necessary relationship of dimensions and threads for the coupling to be effected in a totally sealing-tight manner. It is obvious that the assembly thus formed will have to have negative floatability, that is to say it will under its own weight submerge in the liquid mass in which it is required to operate.

Finally, it has been envisaged that if the artefact does not explode, it shall remain neutralised after a brief period of time has elapsed which represents a further safety factor, since if the device does not operate at the intended moment and time, the resultant neutralisation will prevent its functioning subsequently. This self-neutralisation is optional prior to every launch.

For a better understanding of the contents of this application, it is accompanied by three sheets of drawings which illustrate an example of embodiment of the object for which protection is requested, which is cited and which is represented purely by way of indication and consequently implies no limitative nature. In the said drawings.

Figure 3:
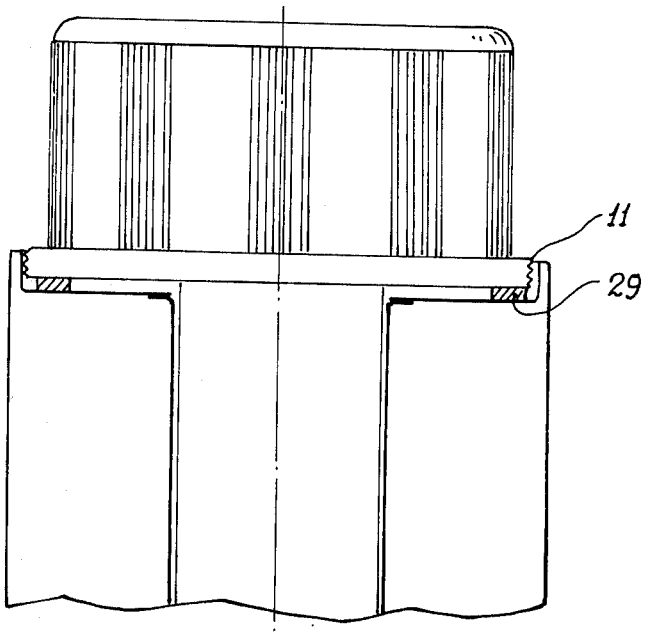
Figure 4:
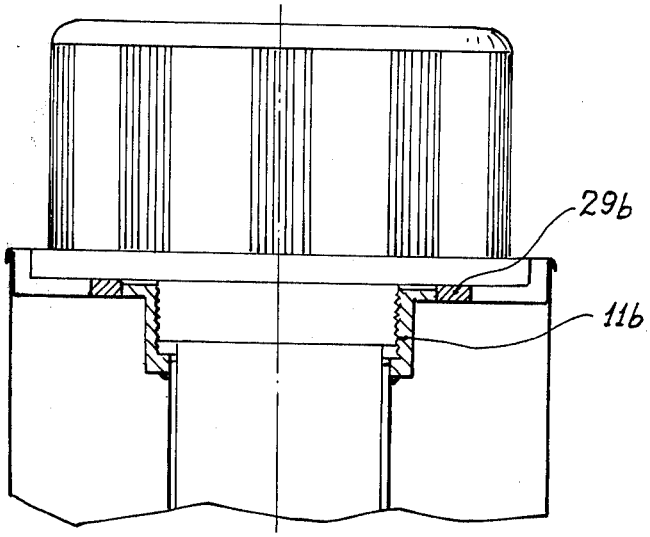

FIGS. 3 and 4 respectively show alternative methods of coupling to the artefact.

In accordance with the illustrations, the object of the present application comprises a cap 3 which screws to the body 7 and the object of which is not only permanently to protect and preserve the mechanisms, but to operate with real safety since by means of the seal 30, it is impossible for water or moisture to penetrate the interior, so that although the artefact may fall into the water or be immersed therein in the case of flooding, or any other similar accident, since water is unable to penetrate through to the interior, it cannot operate and cause the mechanism to function.

A valve 4 is connected also to the body 7 by means of a thread 33 in such a way as to maintain securely captive between the two elements the washer 8 which passes around the entire base of a diaphragm 6, so preventing the water from being able to filter through to the interior. This valve 4 has a small central orifice 2 through which emerges the upper appendage 1 of the diaphragm 6. A series of lateral orifices 5 allow the water to pass to the outer surface of the diaphragm 6. As can be seen from the drawing, this latter is of substantially conical form in order that it may be able to fold on to itself when subjected to the hydrostatic pressure as this increases, the farther the artefact descends below the water. This conical form, in accordance with its mass and rigidity, thus prevents any substantial retraction in the face of any effective inertia, when there is impact with the mass of liquid, whatever its position may be at the moment of impact.

The upper part of the diaphragm 6, as has already been stated, is extended into a small appendage 1 for the sole purpose of being traversed by a pin 37 which acts as a safety device.

As can be seen from the drawings, the said pin 37 prevents the diaphragm 6 from being able to fold over, because it is retained by the pin in the position shown in the drawings. This pin may vary considerably in form (it may be straight, angular or circular) for easier handling and extraction prior to launching.

In the position opposite to the upper appendage 1 there is a second appendage 36, the purpose of which is to maintain the small piston 35, which has two diameters, the smaller or upper diameter, the end of which is located under pressure on the former, and the larger which moves within a cylinder 26, as will be explained hereinafter.

Between the two diameters of the piston 35 a step 34 is created which is fundamental, within the functional device created.

The dimensions of the piston 35 bear a close relationship to the other elements of the device, it being ideal for its mass or total weight to be small which it is why it is made from light materials, mass being eliminated by means of an axial bore, in order to achieve the utmost reduction in the effects of inertia when the artefact strikes the water; in particular, when they are launched from a great height from aircraft or helicopters.

The bottom part of the diaphragm 6 takes the form of a circular washer 8 which is sufficiently thick that, upon being compressed by the valve 4 against the circular seat 32 of the body 7 in which it is housed, it provides a sealing-tight closure which prevents water passing through to the interior, as has already been indicated.

The diaphragm 6 with two appendages 1 and 36 and its circular washer 8 constitute one single member made from suitable elastic material, preferably silicon rubber or synthetic rubber, but not to the exclusion of any other plastics substances, the properties of which are suitable for the intended purposes.

The body 7 or central part of the fuse is a member which in its front third is substantially circular, and which extends in two cylindrical appendages 24 and 26 of different diameters and lengths, coaxially disposed so that the portion of larger diameter 24 and length encloses the other, 26, which occupies a central position.

This body 7, constructed from thermoplastics or thermostable material preferably serves as a support and guide for the other elements of the device and has the following particular features: at its upper part, the thread 33 allows it to be coupled to the valve 4. Beneath this thread 33, a circular seat 32 receives the washer 8 of the diaphragm 6. In this seat, various concentric grooves which can be seen in the drawing ensure an hermetic seal when the valve 4 compresses the washer 8.

A second thread 31 serves to receive the cap 3. Contiguous with this thread 31 is an annular recess in which is accommodated an O-ring 30 which is compressed by the cap 3 when this latter is screwed fully home.

The bores 9 and 12 allow the conventional passage of water into the interior when it is desired to neutralise the artefact in the event of failure.

Figure 1:
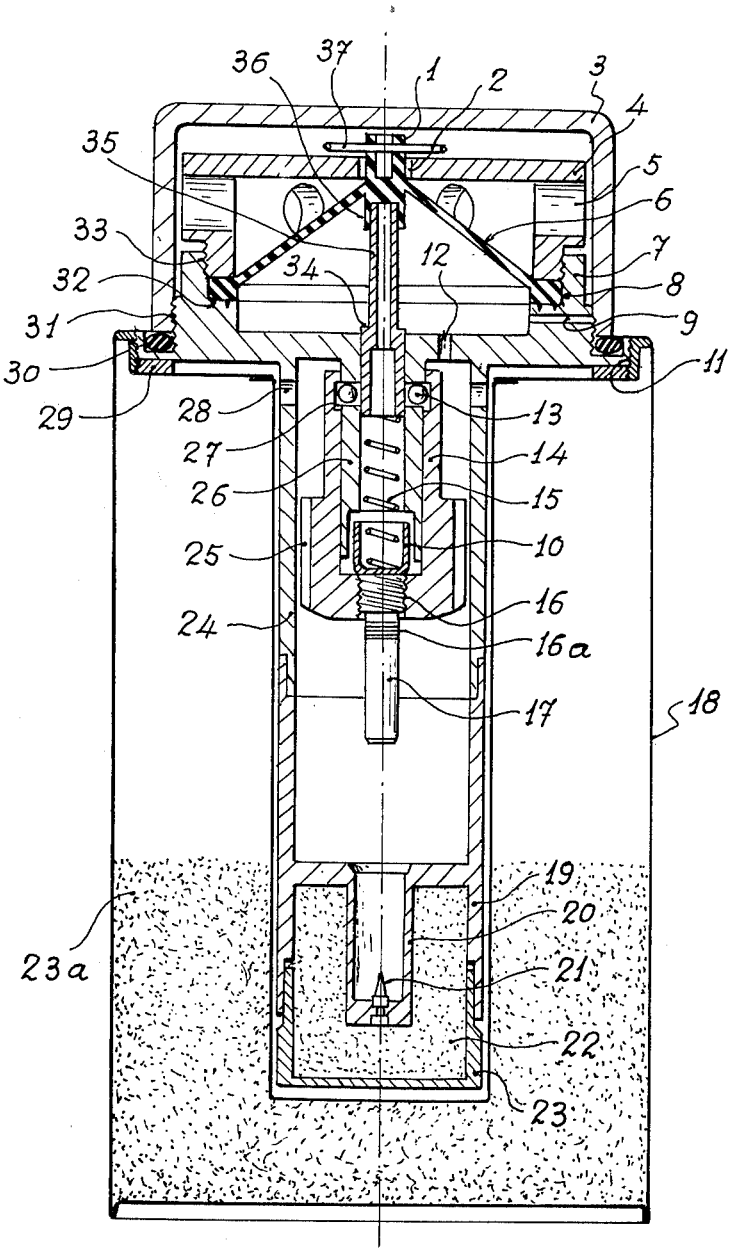
FIG. 1 shows a longitudinal section through a safety fuse according to the invention , coupled to a depth-charge or mine, the explosive power of which independently of the quality thereof, depends on the total volume or quantity contained in the protective casing or receptacle.

As can be seen in FIG. 1, the central appendage 26 of the body 7 is a cylindrical tube having a wall of sufficient thickness to contain four small balls 13, the diameter of which is greater than the wall thickness, without being as much as to double it, in order that there always projects from the partition a spherical dome having a radius which is smaller than the thickness of the partition or wall.

The said four small balls 13 are located in respective bores provided in the wall of the appendage 27, with 90° separation between centres and a very close tolerance.

The inside surface of this tubular appendage 26 corresponds to the outer surface of a piston 35 in such a way that the latter can slide on its inside with neither excessive tightness nor excessive clearance.

The outer appendage 24 receives in its rear part or free end the casing 19 which contains the booster explosive 22 and the percussion device 21. In its front part close to the base of the body 7 can be seen the orifices 28 made when providing the four bores which carry the small balls 13. Between the outer surface of the appendage 26 and in the inner surface of the second appendage 24 there is sufficient space to accommodate the firing piston 14 which is in one piece which is substantially cylindrical and has two diameters, as the drawings show. On its inside face and close to its end it has an annular rebate or notch 27 in which the four small balls 13 are located.

The inside diameter of the piston 14 corresponds to the outside diameter of the appendage 26 in such a way that the former is capable of sliding along the latter with no excessive tightness nor play. In the same way, the rear and external part of the piston 14 slides smoothly along the inner surface of the appendage 24.

Various bores 25 allow the passage of air without arresting it, when the piston 14 is fired in the direction of the percussion pin 21.

The detonator 17 is connected to the piston 14 by means of the thread 16. A spring 15 performs a dual function: firstly that of regulating the firing depth and once this has been reached, it acts as a firing element. As can be seen in FIG. 1, this spring 15 is a coil spring of a length, strength and characteristics calculated beforehand and ratified by experiment, which is located inside the appendage 26, with the front end bearing on the base of the piston 35 while its rear end is seated on the bottom of the piston 14.

The casing 19 which houses inside it the booster charge 22, is connected to the appendage 24 indiscriminately by pressure, by closefriction or by a screwthreaded engagement. The central part of this housing 19 extends in a closed tube 20, into the base of which is inserted the percussion pin 21 which occupies a central position. Through the rear part of the casing 19 is inserted a compressed booster explosive charge 22 which may be of tetralite, pentrite, hexogen or other suitable substance. The form of this compressed charge will exactly correspond to that of the space in the casing 19, as can be seen in the drawings, the casing being closed by means of the cap 23 which fits under pressure or by means of a thread.

The fuses are coupled to their respective artefacts by means of a thread, although any other form of connection such as a bayonet fitting or the like, may be used.

FIG. 1 shows the coupling to a small underwater mine or charge 18 by means of a thread 11 provided on the larger diameter part of the fuse, corresponding to the thread on the artefact. The seal or gasket 29 ensures sealing-tightness between the two elements.

This form of connection is shown in greater detail in FIG. 3, reference numeral 11 denoting the thread and 29 denoting the sealing-tight gasket.

Figure 2:
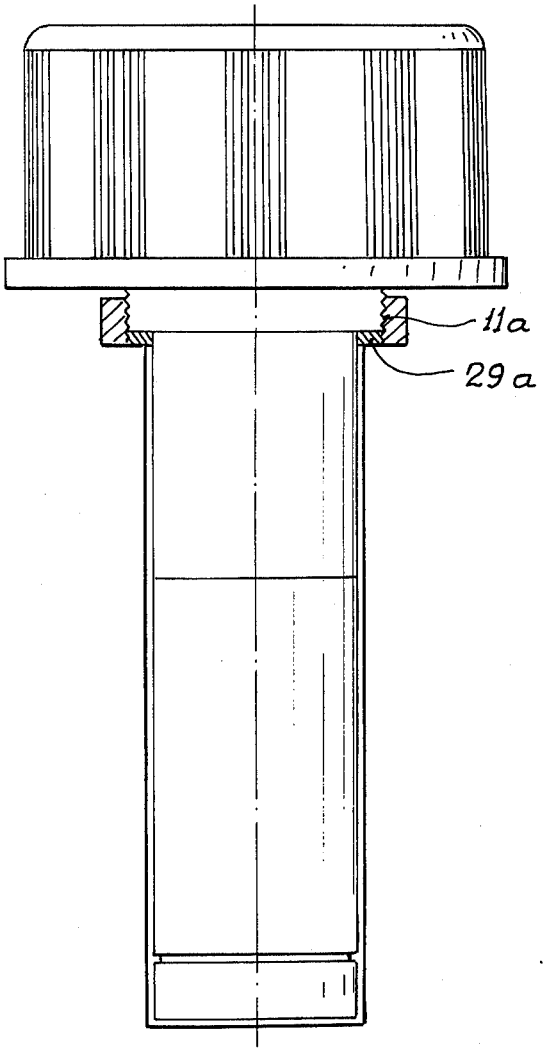
FIG. 2 shows the same fuse coupled to a simple tubular plug which contains no more explosives than that contained in the fuse since in this case the effects which are aimed at are not destructive as the consequence of a great explosion but simply acoustic, for submarine signalling, dredging of acoustic mines and other practices.

The thread for connecting the fuse to the respective mine or charge may also be made as shown in FIG. 2. Below the thread **11*a* is a seal 29*a*** which shuts off the passage of water to the interior.

Finally, FIG. 4 shows the coupling of the fuse to the charge by means of a threaded cap **11*b*, around the periphery of which there is the sealing-tight gasket 29*b***.

The basic constitution of the invention having been described, it functions as follows: let it be assumed that the fuse is adjusted to its charge, with the elements disposed as shown in FIG. 1, it functions as follows: when the cap 3 is unscrewed, the artefact is deprived of the primary safety feature because when the cap is tightened fully, function is impossible because the water cannot pass to the interior. When the cap 3 is removed, there remains a second safety device 37 which traverses the appendage 1 of the diaphragm 6, also preventing functioning because it does not allow the diaphragm to lower and therefore all the elements remain substantially in the position shown in the drawing. When this safety device is removed, the artefact is thrown into the water so that it submerges, having negative floatability, and water starts to enter through the lateral orifices 5 and also through the small central orifices 2. As the artefact descends to increasing depth, the hydrostatic pressure increases and acts with increasing force on the entire outer surface of the diaphragm 6 which becomes compressed so that it is moved towards the interior. This movement of the diaphragm 6 results in movement towards the interior of the piston 35, progressively overcoming the resistance opposed by the spring 15, a resistance which becomes increasingly greater and which is augmented by: the resistance offered by compression of the air enclosed in the interior which, by reason of its construction, allows no escape or outlet of any kind and also, although on a measured scale, it is necesary to consider the resistance offered to movement of the piston 35 by the four balls 13 which are urged towards the interior with increasingly greater force by the step 27 on the annular rebate of the piston 14 in accordance with the increasing thrust which the spring 15 transmits as it is increasingly compressed on the bottom of the piston 14.

As it moves progressively inwards, the piston 35 compresses to an increasing extent the spring 15 and it descends until its step 34 passes beyond the line of the four balls 13, at which moment firing will occur, since the balls 13, urged in sliding fashion by the inner step 27 encounter an inwards projections and cease to retain the piston 14 which is impelled violently by the spring 15 being launched with its detonator 17 forwards against the percussion pin 21, which collision gives rise to the envisaged explosion since, at the moment of percussion the detonator 17 assumed a position in the central part of the booster explosive 22, the optimum position for a complete explosion of this latter, which results in explosion of the main charge 23a contained inside the casing 18.

It should be remarked that until the precise moment of firing, that is to say until such time as the artefact has reached the intended depth, the detonator 17 will have remained remote from the booster charge 22 and from the main charge 23*a* and only when the intended moment of firing is reached, when the charge is under water and at a specific depth, but no sooner, is the detonator 17 moved into the central portion of the booster charge 22, leaving the safety position which it occupied until that moment. In consequence, only after firing has occurred does the detonator 17 leave the safety position. Thus any risk of accident which may result in explosion of the detonator 17 is overcome, since if this latter should happen to detonate (whatever its cause may be: accident, fortuitous circumstance or intention), being in the position shown in the drawing, the general explosion will not occur because the distance between the detonator 17 and the booster explosive 22 or between the detonator 17 and the main charge 23*a* is such that, calculated in advance and proven by experiment, the hypothetical detonation of the former would reach one and other explosive in greatly dimished form, without having the necessary energy heat and mainly pressure needed to cause the explosion; for this reason, the two elements, that is to say the booster charge and the main charge 23a would not assist the accidental explosion of the detonator 17, remaining inert.

From the foregoing description, the simplicity of series-manufacture will have been realised, since the characteristic features and specifications of the common parts are the same, these are interchangeable, the devices thus constructed following the same functional process which has been described; therefore, the depth at which the explosion occurs will for practical purposes be the same for all of them.

As firing occurs when the step 34 of the piston 35 goes beyond the line of the small balls 13, it will be understood that there is a possibility of varying the depth of explosion at will, the explosion being either brought forward or delayed: we would achieve an advance if the piston 35 encountered less resistance to forward movement and, on the other hand, a delay would be achieved if greater resistance is offered to the piston 35; hence, the most elementary methods of achieving this may be, in the first case, to shorten the distance between the bottom of the piston 35 and its step 34; to shorten the length of the spring 15 or to replace it by another of less strength. In the second case, in order to delay the moment of explosion, it will be necessary to proceed in the opposite way: to lengthen the first-mentioned distance, to lengthen the spring 15 or to replace it by another of greater strength.

Reference to FIG. 1 will show how it is possible to act on the spring 15 in order that this latter may offer greater or less resistance to movement of the piston 35, which would make it possible to carry out prior regulation of the depth at which the explosion is to occur.

The bottom end of the spring 15 rests on the end of a cap 10 so that it will be sufficient to move the said cap 10 upwards, according to the position shown in the drawing, for the spring 15 to be compressed, the more so the greater is the movement imparted to the cap 10. This movement is regulated by screwing the detonator 17 farther in or out because, as this moves forward, the result is a co-relative forward movement of the cap 10 which is supported thereon.

A series of annular grooves 16a made in the outer part of the detonator 16 and duly calculated in advance, make it possible at any time to know the amount of forward movement of the cap 10, and therefore the extent to which the spring 15 has been compressed in each case, which after all is tantamount to knowing the amount to which the force of the spring 15 is increased in each of the successive positions occupied by the detonator 17, according to the advance imparted to it by screwing. These intermediate positions are comprised between an upper limit and another lower limit. The first is reached when the cap 10 encounters the step of the annular rebate in which it is located, at which moment neither the cap 10 nor the detonator 17 can move any farther forward; and the second or lower limit corresponds to the moment when the cap 10, as indicated in the drawing, meets the bottom of the piston 14, an extreme position which cannot be exceeded.

Between the two limit positions there is a series of intermediate positions which are regulated by in each case manually rotating the detonator 17 until the base of the piston 15 is made to coincide with the groove 16*a* which is most suitable for the intended purposes.

In the event of a failure, the device can be neutralised by means of the two bores 9 and 12 which allow water to pass through the inside of the fuse until it is completely flooded; in this way, the internal and external pressures are finally balanced and therefore as the hydrostatic pressure acts in both directions with equal force, the diaphragm 6 will not be urged inwards and consequently the piston 35 will remain in the position shown in the drawing, lacking the force needed to compress the spring 15 and firing cannot take place.

It will be understood that this passage of the water to the interior of the artefact will be increasingly slower the smaller is the diameter of the bore 9. It is sufficient to plug this with a soapy or similar substance so that only after this has been dissolved can water pass to the interior, the normal functioning remaining undisturbed until that happens. On the other hand, once the water floods in to the interior of the fuse, functioning will not be possible, as has been explained previously. The time it will take to achieve neutralisation of the device will be a direct consequence of the delay in dissolving the substance which is used to block the bore 9.

Experiment has shown that these results are obtained likewise if the orifice 9 is blocked with a wick or small ball of cotton or textile substance; the water penetrates slowly by capillary action until, at the end of a certain time, the desired effects are achieved.

The industrial object of this patent of invention having been described and illustrated fully and with sufficient clarity for it to be put into practice, the incidental details relating to the assembly or to its component parts, may be modified subject to compliance with the unaltered essential features which are summarised in the following claims:

I claim:

1. Safety fuse for underwater artefacts, comprising:

a body having an open end; a valve head closing said body open end; said valve head being secured to said body;

a diaphragm located in and sealingly dividing said body into a primary and a secondary chamber; said diaphragm being deformable to change the relative sizes of said primary and secondary chambers; said diaphragm having an annular peripheral flange which is secured inside said valve head; said diaphragm having a generally conical shape with a central portion projecting further into said valve head than said diaphragm peripheral flange;

passages into said valve head from the exterior of said body and communicating into said primary chamber, thereby to communicate the ambient pressure around said safety fuse into said primary chamber;

a first piston attached to said diaphragm to shift therewith and being mounted and oriented to be movable axially through said body as said diaphragm deforms; said first piston being of lightweight construction and being tubular with an axial bore therethrough;

a second piston axially spaced from said first piston and also being positioned and oriented to be axially movable through said body; a compressible spring between said first and said second pistons, which is compressed as said first piston is moved toward said second piston by said diaphragm;

restraining means for restraining motion of said second piston under the influence of said spring; release means connectable with said first piston and located for releasing said restraining means once said first piston has moved a predetermined distance toward said second piston;

a detonator connectable with said second piston to be moved by said second piston; impact means in said body to be impacted upon by said detonator and spaced from said detonator as said second piston is restrained by said restraining means, such that release of said restraining means and of said detonator enables said detonator to impact against the cooperating said impact means to initiate detonation of a charge.

2. The safety fuse of claim 1, further comprising protective cap engaging means located on the exterior of said body and being so placed that a protective cap may be placed over said valve head to cover said valve head and to engage said cap engaging means;

a protective cap shaped to cover said valve head and said passages and including means for sealingly engaging with said protective cap engaging means.

3. The safety fuse of claim 2, wherein said valve head has a support portion adapted for supporting said diaphragm and that is normally spaced away from said diaphragm; a bore through said valve head support portion; an appendage attached on said diaphragm and extending through said support portion bore;

removable retaining means attachable to said diaphragm appendage extending through said valve head support portion bore; said diaphragm being normally inherently biased to remove its said appendage from its said valve head support portion bore, whereby said retaining means for said diaphragm appendage prevents motion of said diaphragm upon fluid pressure entering said primary chamber.

4. The safety fuse of claim 2, wherein said diaphragm peripheral flange is held at the location of securement of said valve head to said body.

5. The safety fuse of claim 1, wherein said first piston has two sections arrayed axially along its length, comprising a first section closer to said diaphragm and a second section closer to said spring; said first piston first and second sections being of different diameters;

said restraining means engaging said first piston such that said first piston moves axially with respect to said restraining means; said restraining means release means being adapted to release said second piston upon said first piston moving so that the connection between said first and said second sections of said first piston passes said restraining means and said restraining means is thereby caused to release said second piston, whereby the connection between said first and said second sections comprises said restraining means release means.

6. The safety fuse of claim 5, wherein said body extends away from said valve head; two concentric cylindrical appendages extending away from said valve head into said body axially of said body and comprising an internal and an external cylindrical appendage; said second piston being guided for axial motion between said appendages.

7. The safety fuse of claim 1, further comprising second passages from the exterior of said body into said second chamber; water soluble material plugging said second passages and adapted to dissolve in water after a predetermined period of time.

8. The safety fuse of claim 6, wherein said first piston first section is narrower in diameter than said first piston second section;

said first piston second section having a diameter substantially equivalent to the inner diameter of said internal cylindrical appendage; said first piston being guided for axial movement by and inside said internal cylindrical appendage;

said restraining means comprise a shiftable engaging means supported in said internal appendage and means biasing said engaging means against said first piston;

said shiftable engaging means being in position to engage and block said second piston against motion when said engaging means is engaging said first piston second section and said first piston first section being shaped to enable said engaging means to move out of position to block said second piston when said engaging means engages said first piston first section, whereby the connection between said first piston first section and said first piston second section serves as said release means for releasing said second piston for motion.

9. The safety fuse of claim 8, wherein said shiftable engaging means comprises a plurality of orifices and a ball in each said orifice; a groove in said second piston placed to align with said orifices; each said orifice extending through said internal cylindrical appendage between said second piston and said first piston and said balls being normally biased toward said first piston; said balls, internal appendage and orifices being so shaped that with said first piston second section at said orifices, said balls engage in said second piston groove and in said internal appendage and block motion of said second piston.

10. The safety fuse of claim 1, further comprising a housing in said body for explosive material, said explosive material housing being spaced from said second piston and from said detonator as said second piston is being restrained by said restraining means;

a percussion pin in said explosive material housing and so located and adapted for being impacted upon by said detonator upon said second piston shifting under the influence of said spring.

11. The safety fuse of claim 10, further comprising air passages extending through said second piston from the side thereof on which said detonator is carried to the opposite side thereof, whereby as said second piston shifts, air pressure beneath said second piston will not impede its motion.

12. The safety fuse of claim 10, wherein said detonator is shiftable in position along said second piston and with respect to said percussion pin; said spring engaging said second piston by engaging said detonator thereon, such that shifting of said detonator with respect to said second piston regulates the pressure in said spring.

13. The safety fuse of claim 12, wherein said detonator is screw threaded on its exterior and said second piston has a screw threaded orifice matingly shaped to receive said screw threaded detonator, whereby said detonator is shiftable by rotation thereof with respect to said second piston.

14. The safety fuse of claim 13, further comprising a plurality of indicator marks on said detonator and near said second piston, such that the position of said indicator marks indicates the tension of said spring.

* * * * *